US011499398B2

(12) United States Patent
Greci et al.

(10) Patent No.: US 11,499,398 B2
(45) Date of Patent: Nov. 15, 2022

(54) NOZZLE ASSEMBLY FOR SHUNT TUBE SYSTEMS

(71) Applicant: Halliburton Energy Services, Inc., Houston, TX (US)

(72) Inventors: Stephen Michael Greci, Little Elm, TX (US); Ryan M. Novelen, Euless, TX (US); David Grant, Frisco, TX (US); Weiqi Yin, Plano, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 114 days.

(21) Appl. No.: 17/223,195

(22) Filed: Apr. 6, 2021

(65) Prior Publication Data

US 2022/0316301 A1 Oct. 6, 2022

(51) Int. Cl.

| | |
|---|---|
| ***E21B 41/00*** | (2006.01) |
| ***E21B 43/04*** | (2006.01) |
| ***B05B 15/65*** | (2018.01) |
| *E21B 10/60* | (2006.01) |

(52) U.S. Cl.

CPC ..... *E21B 41/0078* (2013.01); *B05B 15/65* (2018.02); *E21B 43/04* (2013.01); *E21B 10/60* (2013.01)

(58) Field of Classification Search

CPC ..... E21B 10/60; E21B 41/0078; E21B 7/18; E21B 43/14; E21B 43/29; E21B 43/04; B05B 15/65

See application file for complete search history.

(56) References Cited

U.S. PATENT DOCUMENTS 2,525,667 A * 10/1950 Wallace ..... E21B 10/18 285/321
3,129,777 A * 4/1964 Haspert ..... E21B 10/61 285/321
5,020,608 A * 6/1991 Oden ..... E21B 7/064 175/21
5,322,134 A * 6/1994 Dahn ..... E21B 7/065 175/21
6,161,636 A * 12/2000 Osborne ..... E21B 7/06 175/21

(Continued)

FOREIGN PATENT DOCUMENTS

WO 2019246011 A1 12/2019

*Primary Examiner* — Yong-Suk (Philip) Ro
(74) *Attorney, Agent, or Firm* — Scott Richardson; Parker Justiss, P.C.

(57) ABSTRACT

A wellbore downhole tool, comprising: a nozzle assembly, the nozzle assembly includes a nozzle including: a cylindrically-shaped tube with a substantially uniform outer diameter across substantially an entire height of the nozzle, at least one retaining body opening located in an outer wall of the nozzle; a holding body including: a conduit, the conduit sized to fit the nozzle there-through, an alignment opening extending from an outer surface of the holding body to the conduit; and a retaining body sized to fit within the alignment opening of the holding body and to contact the retaining body opening of the nozzle when the nozzle is inserted in the conduit such that the cylindrically-shaped tube of the nozzle cannot rotate or move further in or out of the conduit. A method of assembling the wellbore downhole tool is also described.

20 Claims, 11 Drawing Sheets

(56) References Cited

U.S. PATENT DOCUMENTS

| | | | | |
|---|---|---|---|---|
| 6,192,999 | B1 * | 2/2001 | Nguyen | B05B 15/14 175/393 |
| 7,373,989 | B2 | 5/2008 | Setterberg, Jr. | |
| 7,597,141 | B2 | 10/2009 | Rouse et al. | |
| 8,726,994 | B2 * | 5/2014 | Robichaux | E21B 21/02 166/291 |
| 8,833,445 | B2 | 9/2014 | Techentien et al. | |
| 10,024,116 | B2 | 7/2018 | Veit et al. | |
| 10,041,336 | B2 | 8/2018 | Boutte | |
| 2002/0134859 | A1 * | 9/2002 | Gressett, Jr. | B05C 5/027 239/296 |
| 2005/0263616 | A1 | 12/2005 | Chen | |
| 2007/0062686 | A1 * | 3/2007 | Rouse | E21B 43/04 166/51 |
| 2008/0314588 | A1 | 12/2008 | Langlais et al. | |
| 2014/0238657 | A1 * | 8/2014 | Sladic | E21B 41/0078 166/51 |
| 2018/0291710 | A1 | 10/2018 | Rajkumar et al. | |
| 2020/0291742 | A1 | 9/2020 | Woiceshyn | |

* cited by examiner

NOZZLE ASSEMBLY FOR SHUNT TUBE SYSTEMS

BACKGROUND

Downhole tools used in the oil and gas industry can include wellbore downhole tools such as gravel pack tools to help avoid voids in a gravel pack. Some such tools include shunt tube systems which can include sand control screens and a gravel pack placed around the screens for controlling sand production. An incomplete gravel pack can be associated with the formation of sand bridges in the interval to be packed which in turn can prevent placement of sufficient sand along a screen on the opposite side of the bridge, resulting in excessive sand production, screen failure, or wellbore collapse.

BRIEF DESCRIPTION

Figure 1A:
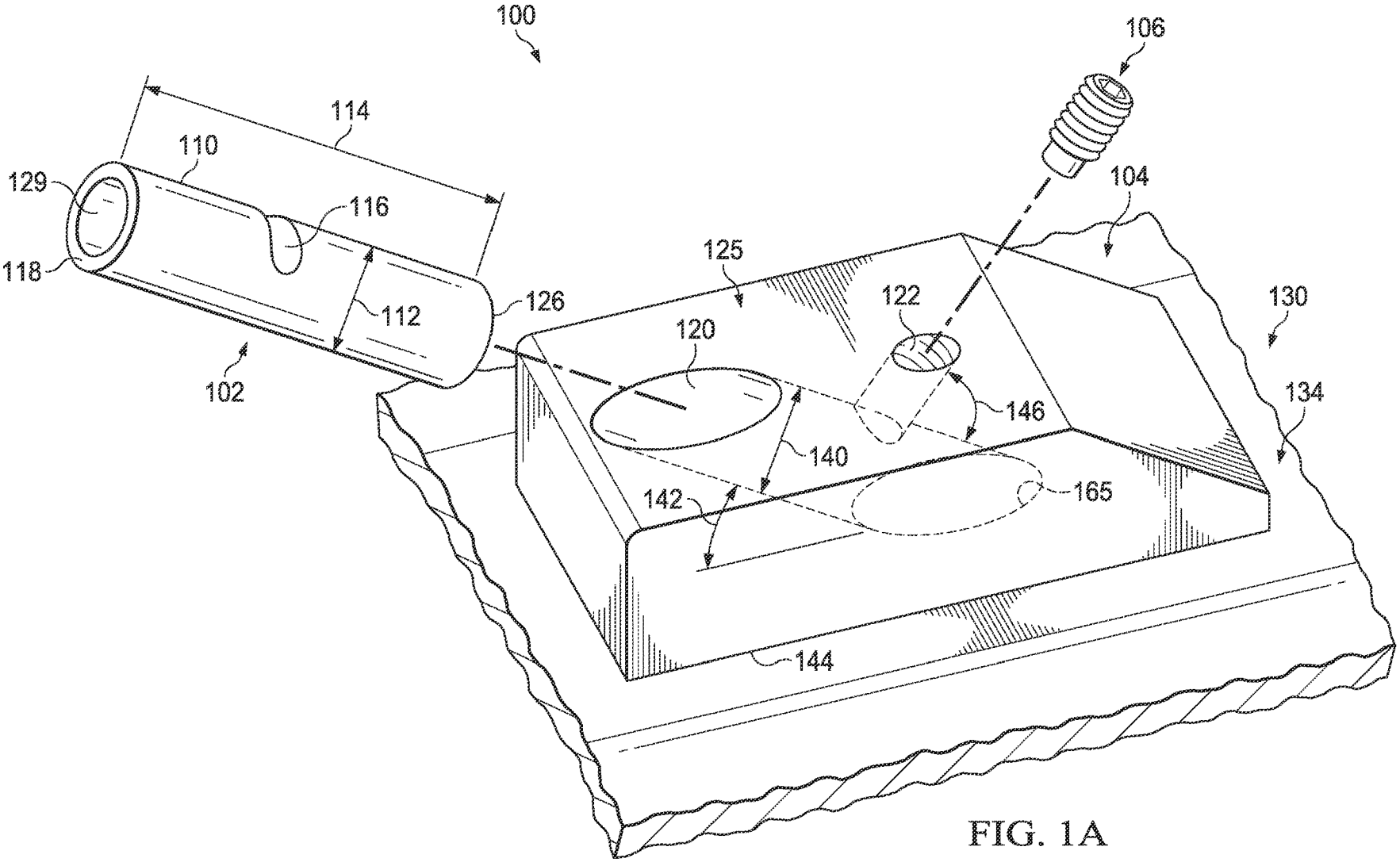
Figure 1B:
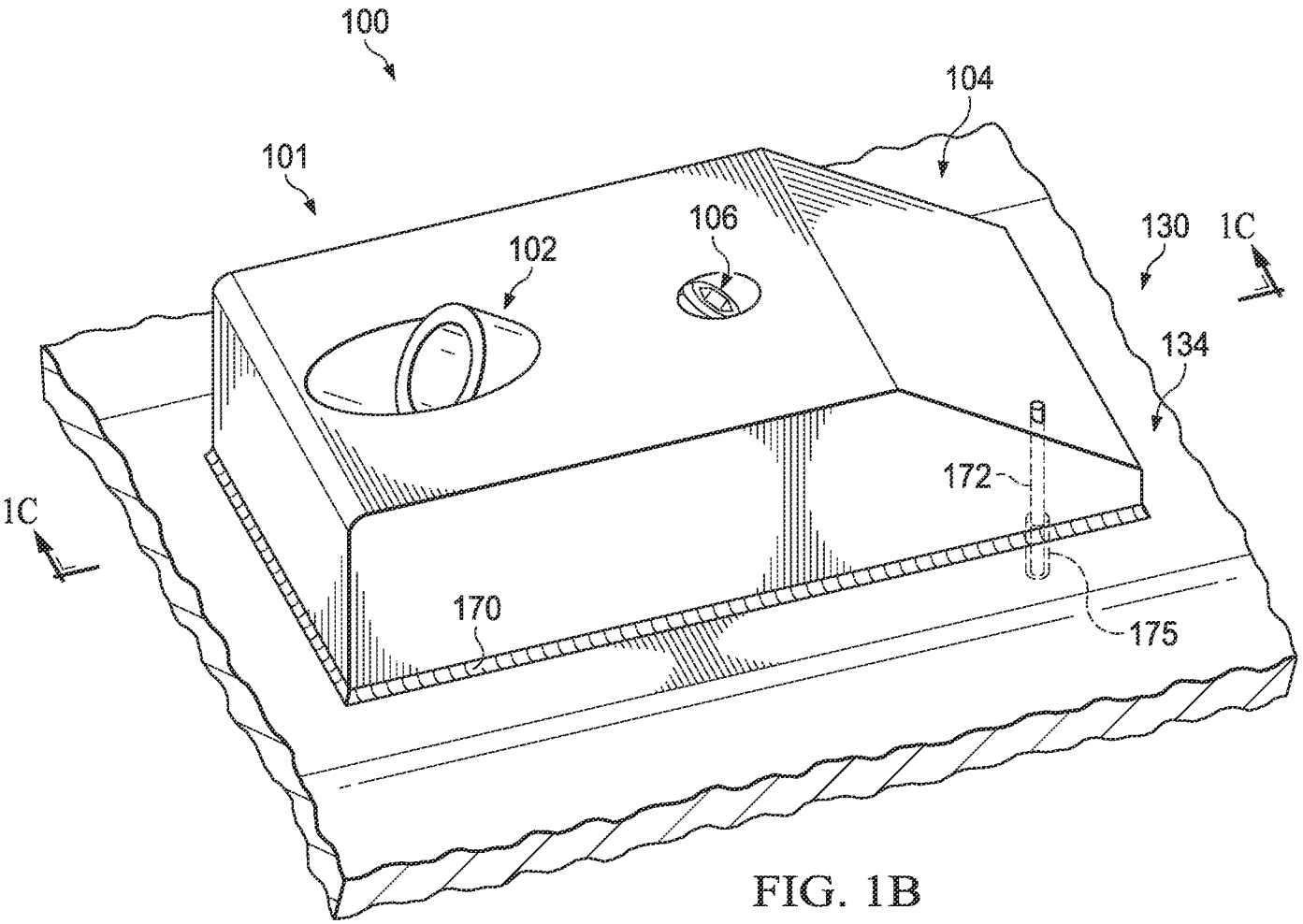
Figure 1C:
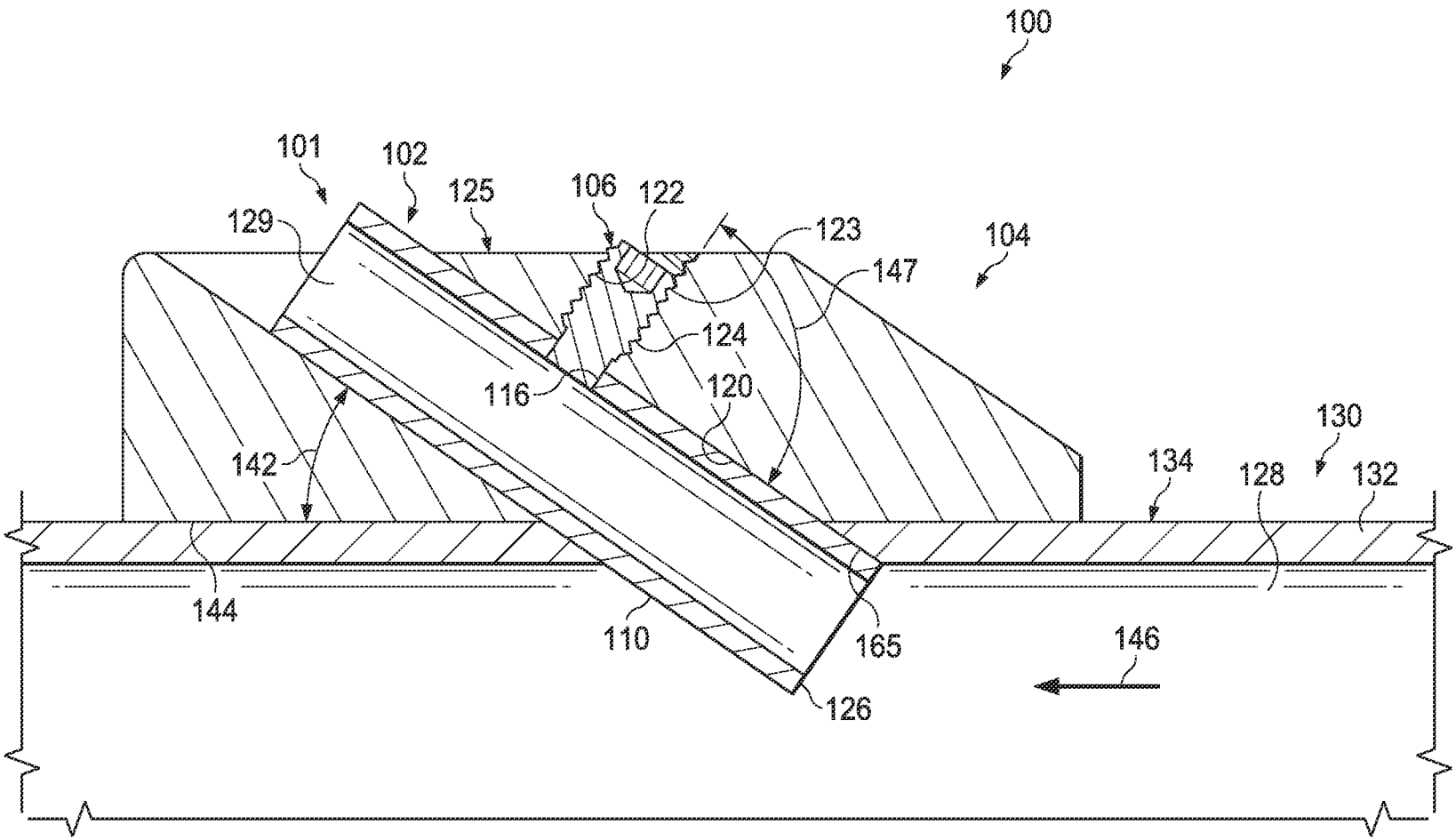
Figure 1D:
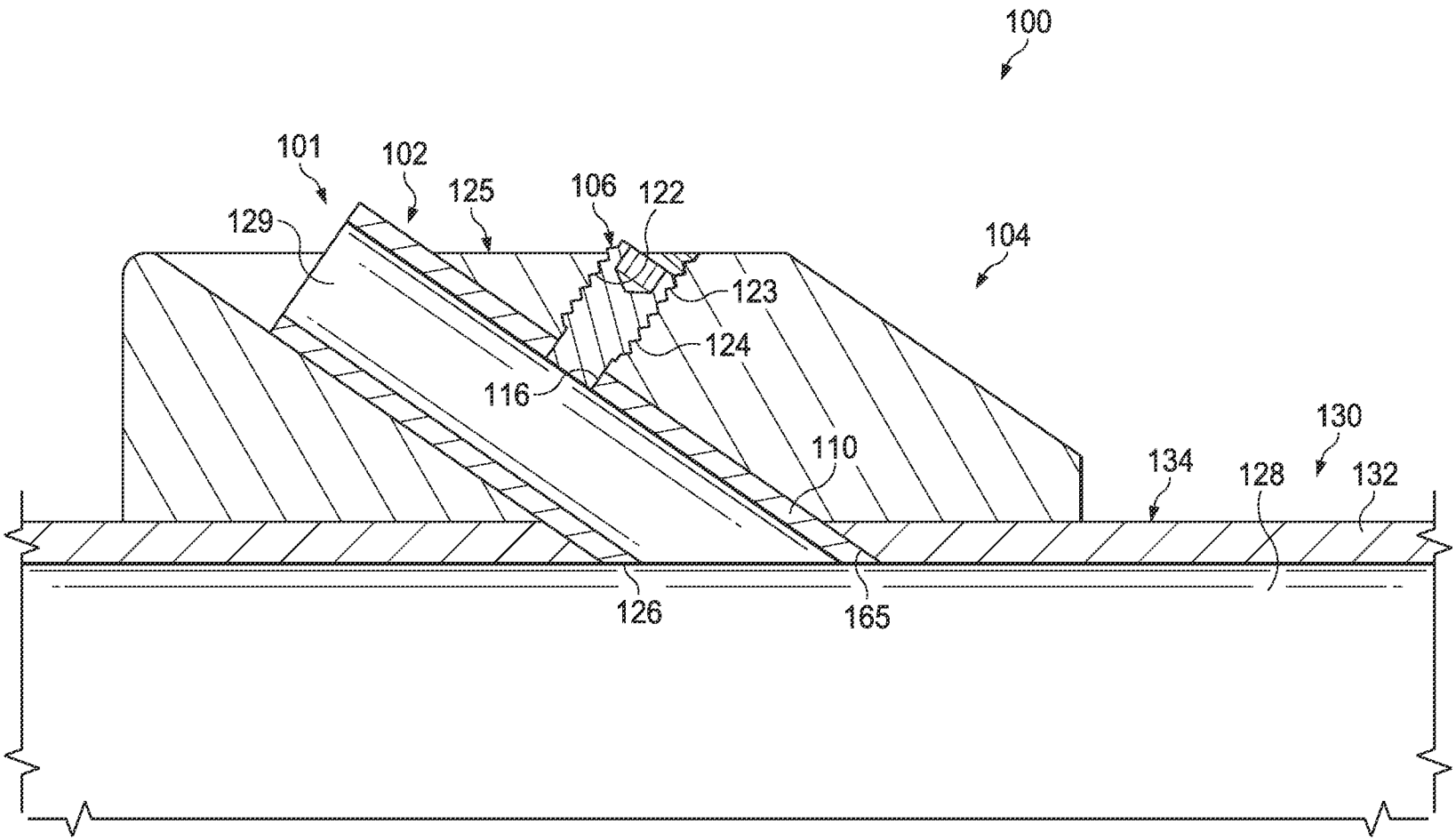
Figure 1E:
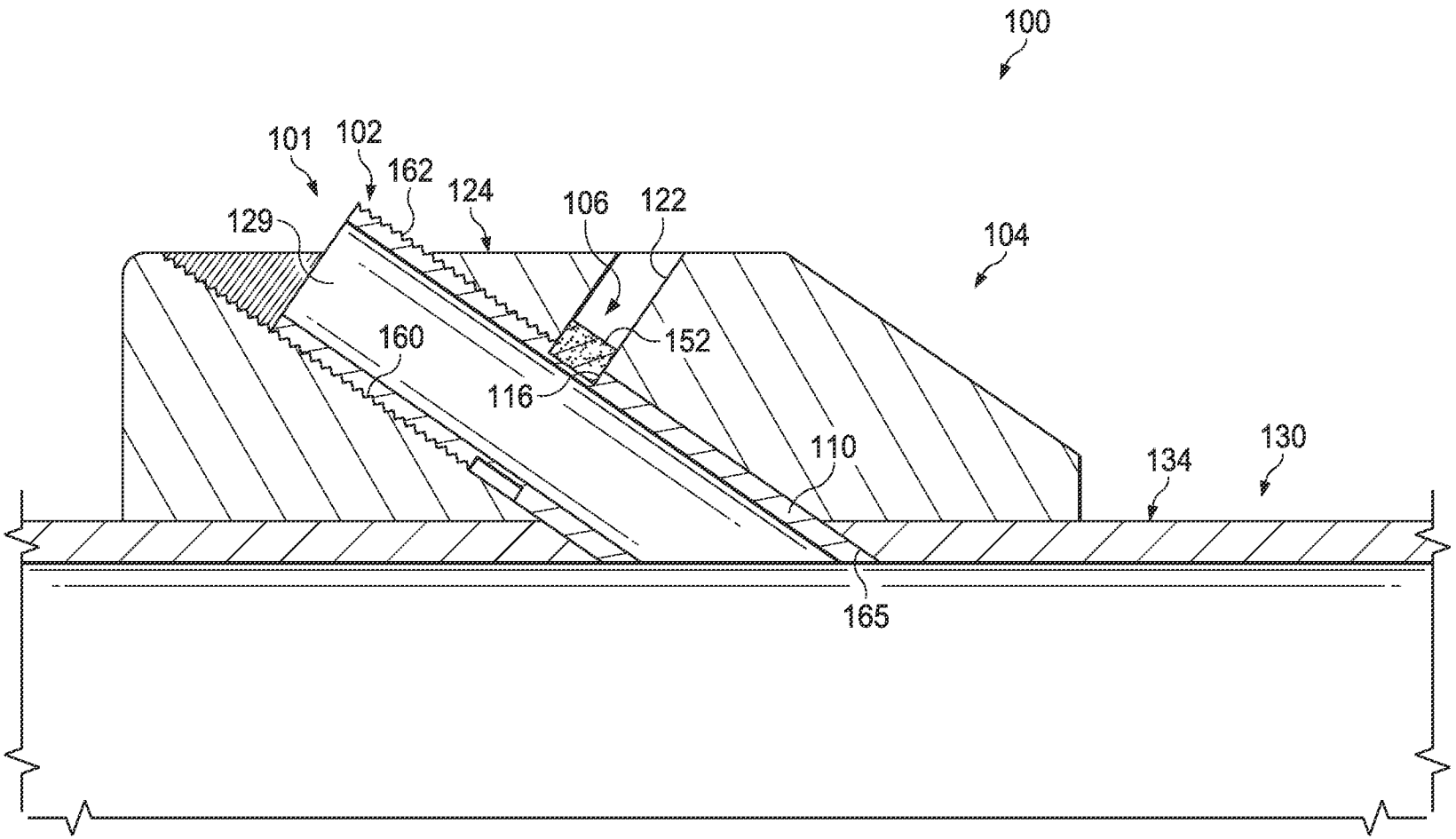
Figure 1F:
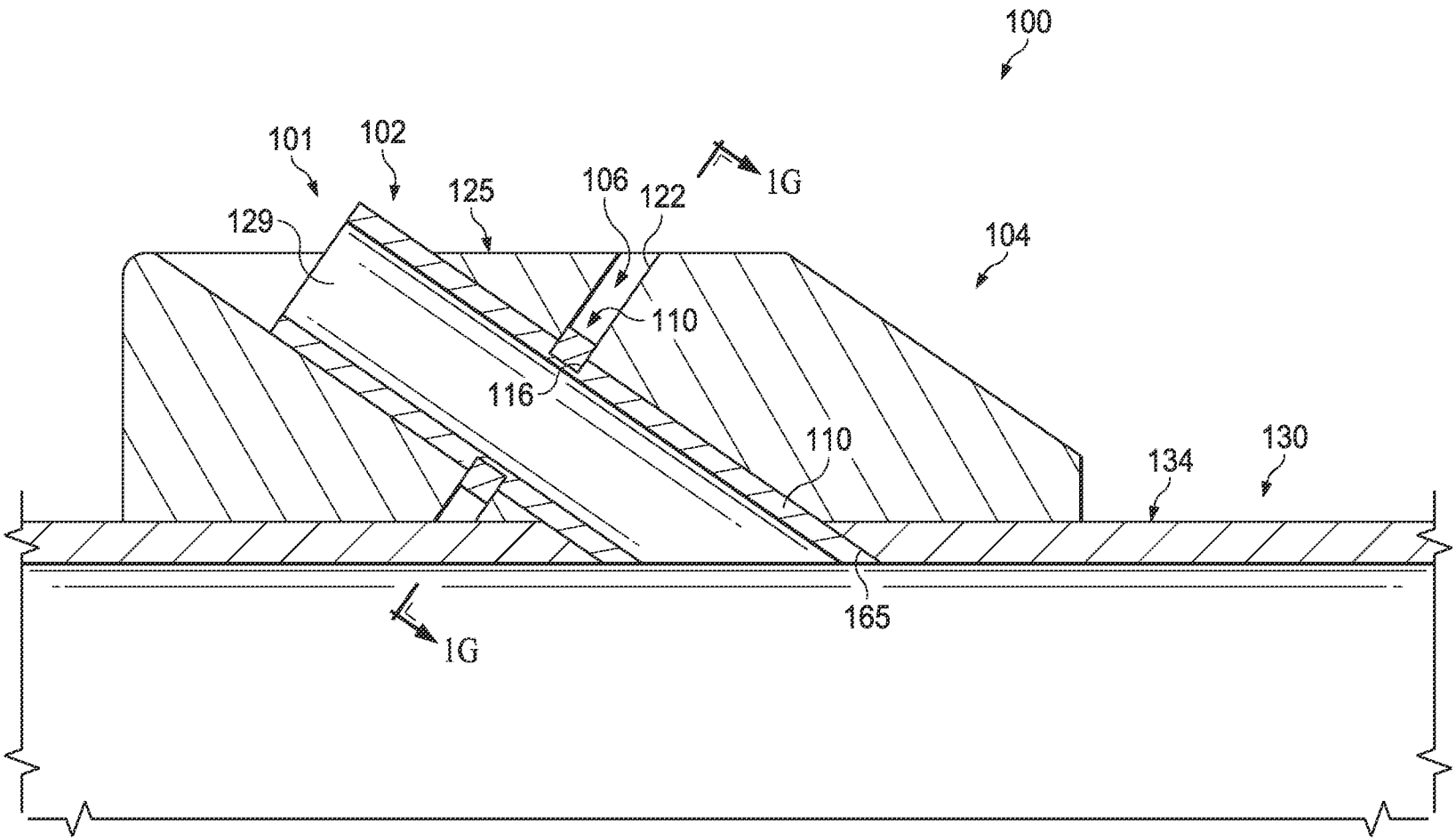
Figure 1G:
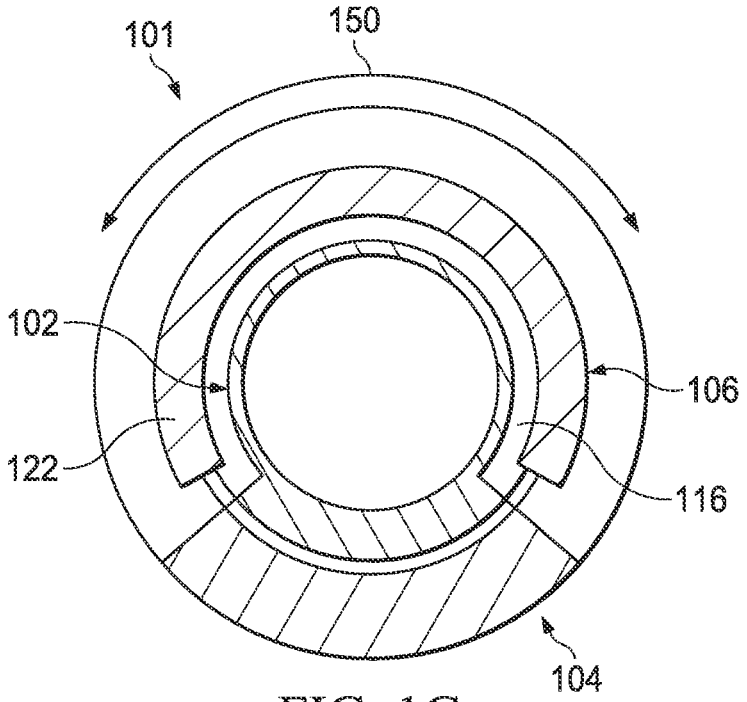
Figure 1H:
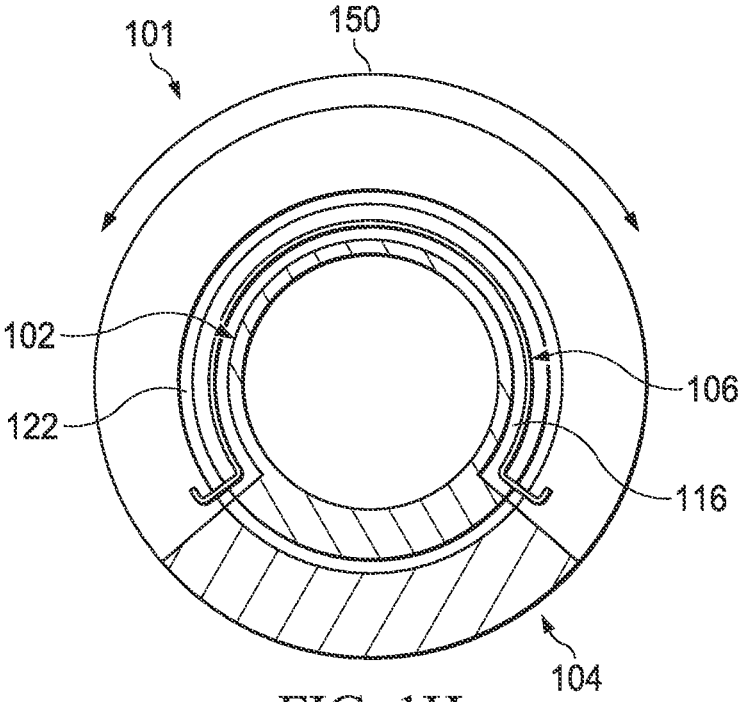
Figure 2:
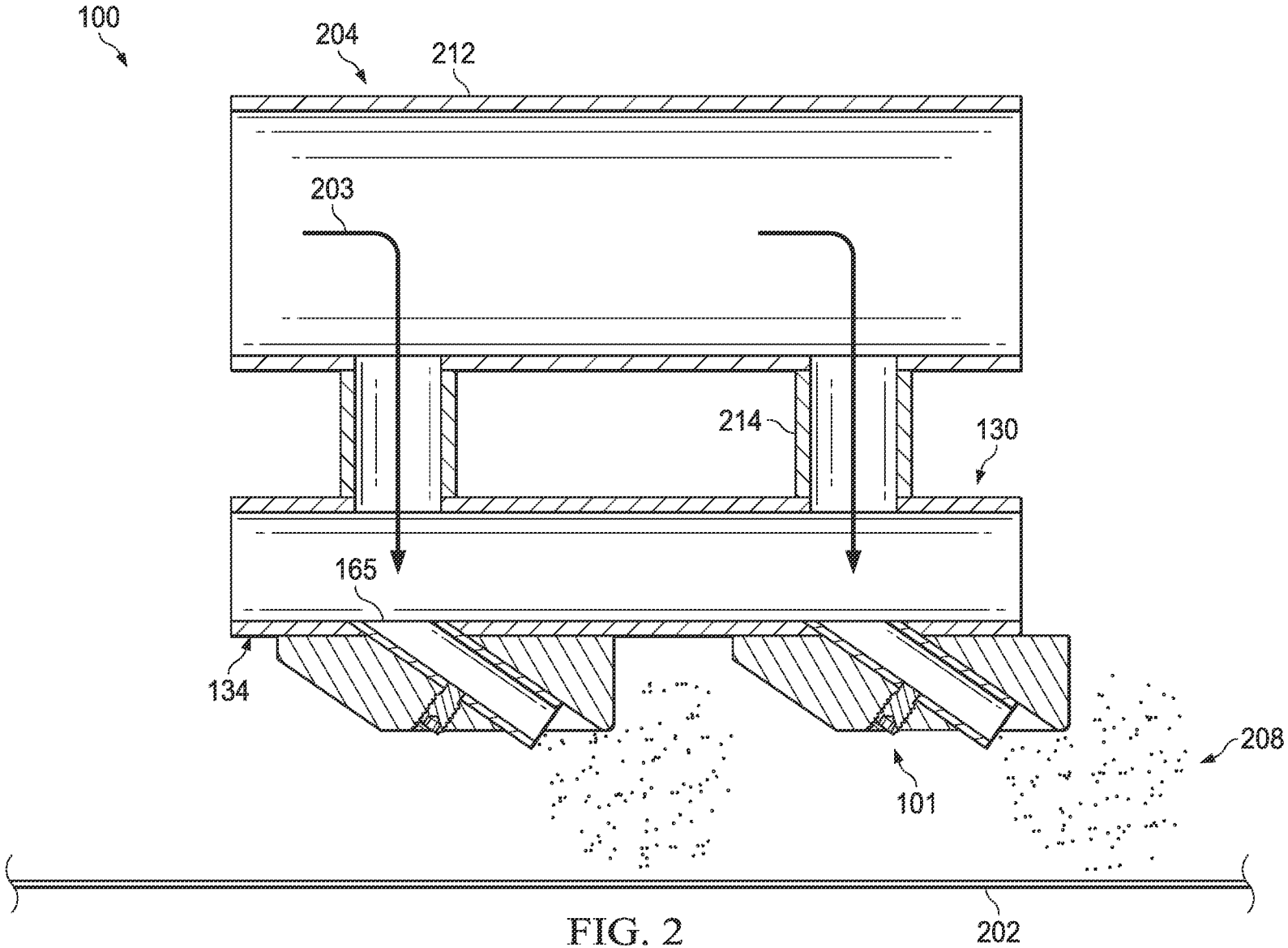
Figure 3:
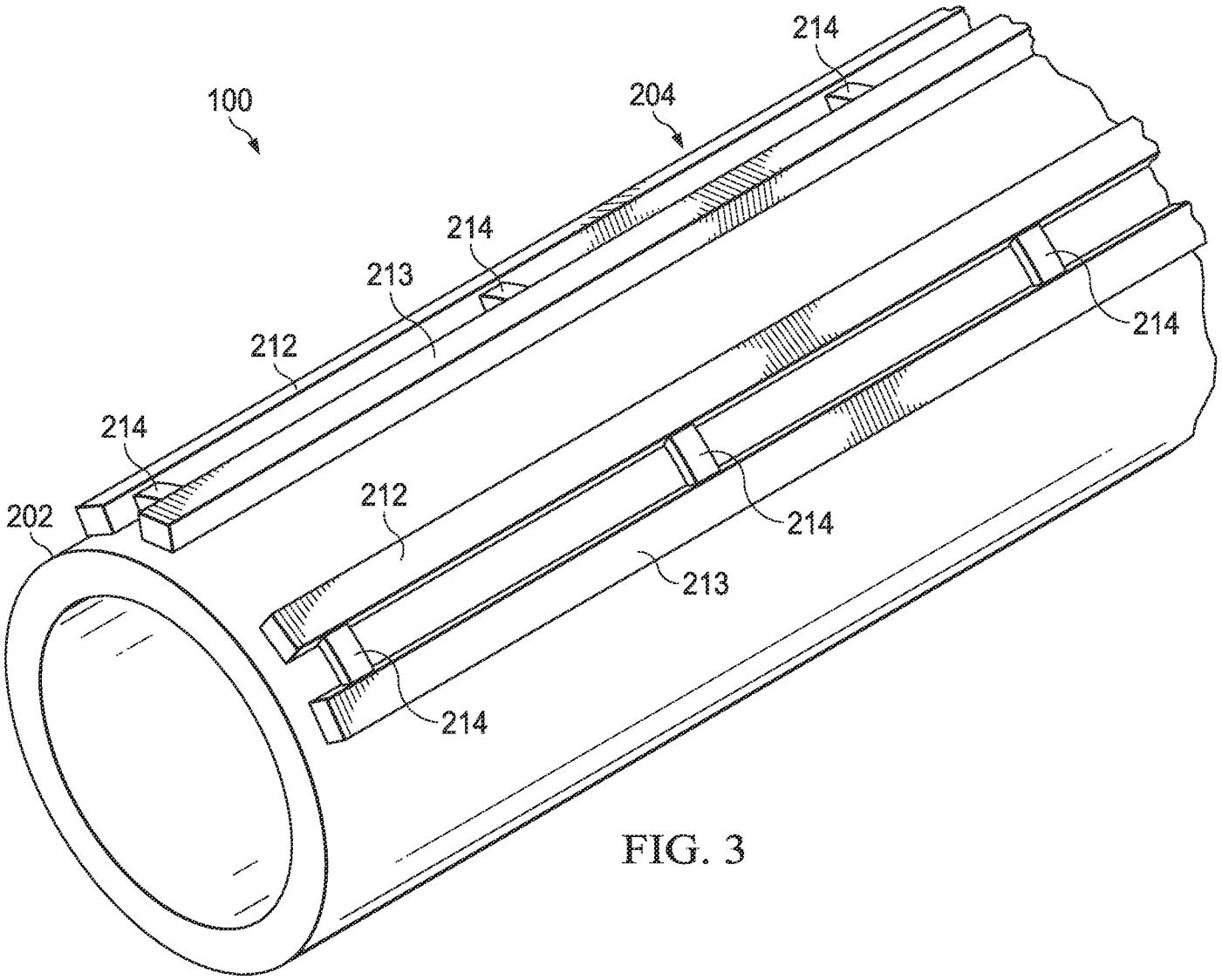
Figure 4:
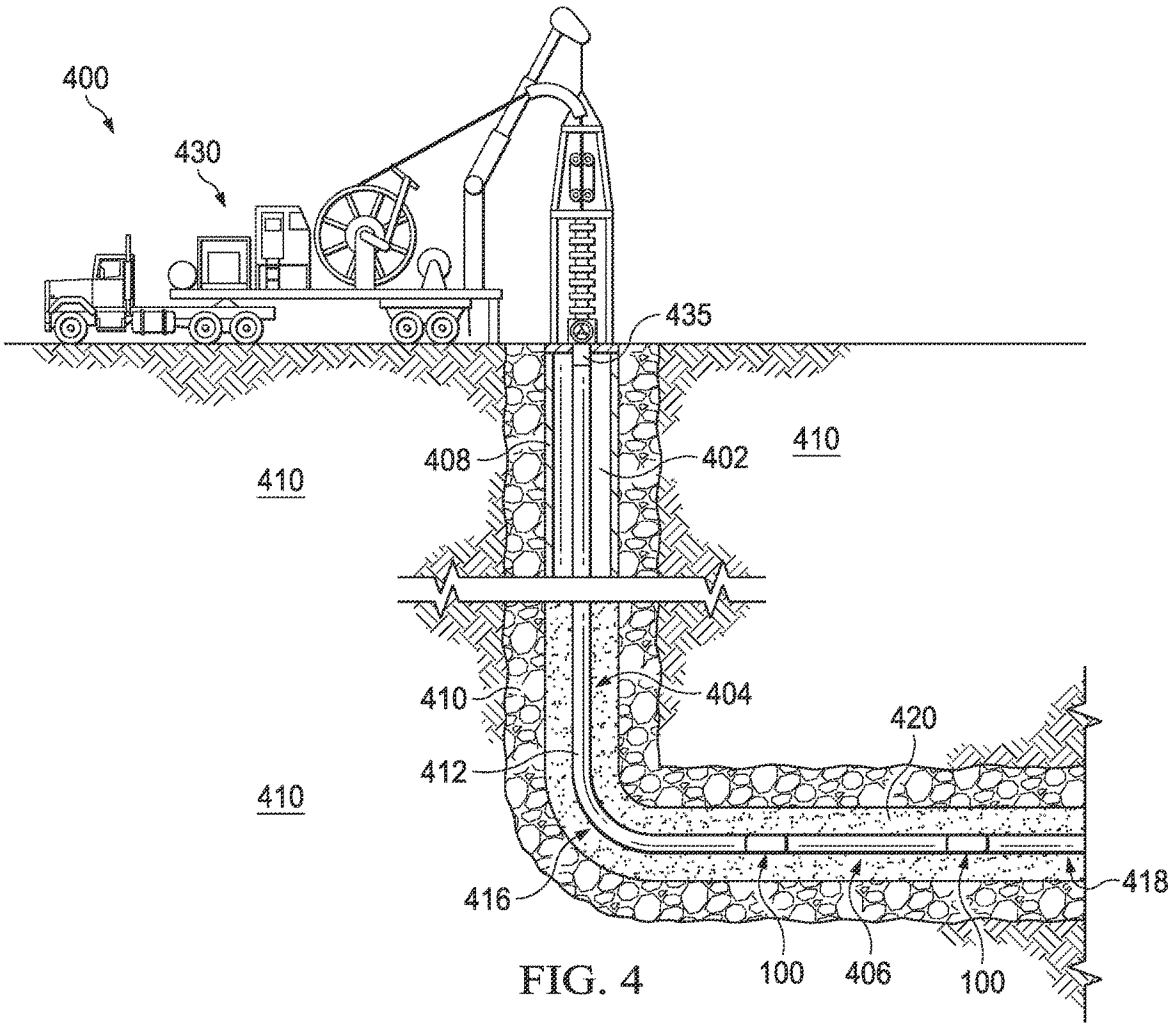
Figure 5:
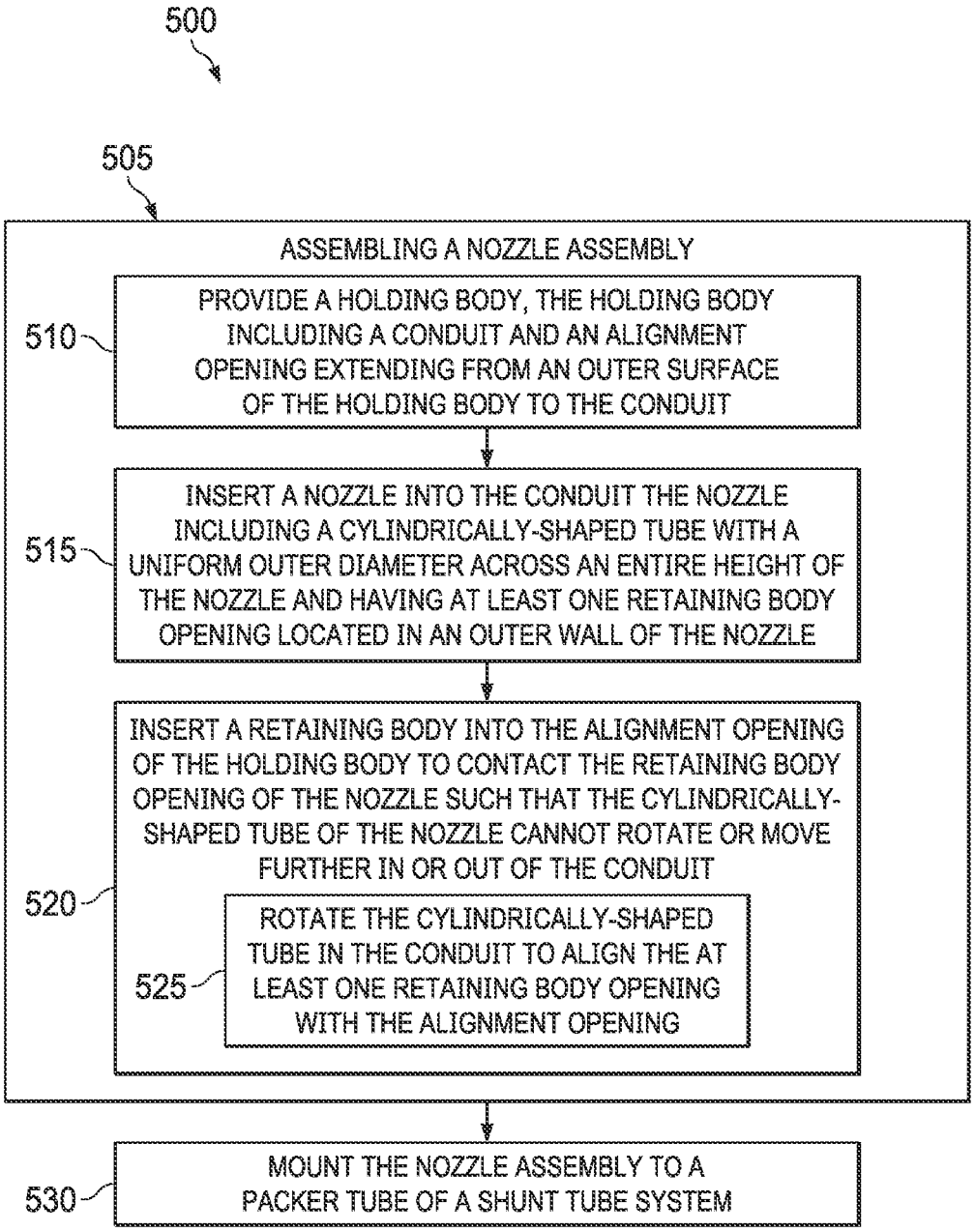

Reference is now made to the following descriptions taken in conjunction with the accompanying drawings, in which:

FIG. 1A presents an exploded side perspective view of an embodiment of a nozzle assembly of a well bore downhole tool of the disclosure prior to assembly;

FIG. 1B presents a side perspective view of the nozzle assembly shown in FIG. 1B after assembly;

FIG. 1C presents a cross-section view of an embodiment of the nozzle assembly shown in FIG. 1B along view line 1C-1C as shown in FIG. 1B;

FIG. 1D presents a cross-section view of another embodiment of the nozzle assembly analogous to the view shown in FIG. 1C;

FIG. 1E presents a cross-section view of another embodiment of the nozzle assembly analogous to the view shown in FIG. 1C;

FIG. 1F presents a cross-section view of another embodiment of the nozzle assembly analogous to the view shown in FIG. 1C;

FIG. 1G presents a detailed cross-section view of the embodiment of the nozzle assembly shown in FIG. 1G along view line 1G-1G as shown in FIG. 1F;

FIG. 1H presents a detailed cross-section view of another embodiment of the nozzle assembly analogous to the view shown in FIG. 1G;

FIG. 2 presents a cross-sectional end view of an embodiment well bore downhole tool with the nozzle assembly as disclosed herein, the nozzle assembly mounted to a packing tube of a shunt tube system as part of the wellbore downhole tool;

FIG. 3 presents a side perspective view of an embodiment of the wellbore downhole tool including a shunt tube system and any embodiments of the nozzle assembly as disclosed herein;

FIG. 4 presents a schematic illustration of an embodiment of a well system having any embodiments of the wellbore downhole tool as disclosed herein; and FIG. 5 presents a flow diagram of selected steps of an example method of assembling a wellbore downhole tool, including assembling embodiments of the nozzle assembly as disclosed herein, in accordance with the principles of the present disclosure.

DETAILED DESCRIPTION

As part of the present disclosure, we recognized certain problems associated with the assembly and use of certain wellbore downhole tools, e.g., a gravel pack tool configured as, or including, a shunt tube system, and in particular, the mounting of a nozzle assembly in the shunt tube system. Nozzle assemblies are used in gravel packing where a slurry (e.g., a gravel slurry) exits the shunt tube system through one or more erosion resistant nozzles of the nozzle assembly onto or about a screen of the tool (e.g., one or more sand screens of the wellbore downhole tool).

Part of our process of assembling the tool can include brazing a nozzle into a stainless metal tube to form brazing joints, and then welding that brazed assembly of the nozzle and the metal tube onto a packing tube of the shunt tube system of the tool.

The term brazing as used herein refers to the process of joining metal materials (e.g., the metal material of nozzle and the metal material of the metal tube) by melting and flowing a filler metal (e.g., a braze metal alloy) into the joint between the two materials. The term welding as used herein refers to the process of joining metal materials by melting one or both of the metals to cause fusion between the metals.

The assembly process can present problems. The brazing process is an additional process step that requires specifications and quality control. When the brazed assembly of nozzle and metal tube is welded to the packing tube, the heat from welding can re-melt the braze with a consequent potential failure of braze joints. There is also an inherent problem with brazing a carbide nozzle to a stainless steel tube due to large differences in the thermal expansion coefficients of carbide versus stainless steel. For instance, the carbide nozzle can crack during a subsequent post-braze cooling process, and in some cases, a certain degree of cracking has to be tolerated as part of assembly and use of the tool.

To address these problems, we have developed a nozzle assembly, and method of assembly, where a nozzle is mechanically connected to a holding body without brazing. The braze-free nozzle assembly can be mounted via a holding body to a packing tube such that the nozzle is aligned with an exit hole in the packing tube. Additionally, the holding body helps to protect the packing tube exit hole from wear due to the passage of slurry there-through. The assembly of the wellbore downhole tool includes assembling the nozzle assembly and mounting to the packing tube with the elimination of a brazing step and thus avoid the problematic issues associated with welding on top of a brazed joint to reduce manufacturing costs.

One aspect of the disclosure is wellbore downhole tool 100 that includes a nozzle assembly. FIGS. 1A-1G illustrate various embodiments of the nozzle assembly 101 of the disclosure. With continuing reference to FIGS. 1A-1G throughout, embodiments of the nozzle assembly 101 can include a nozzle 102, a holding body 104 and a retaining body 106.

Embodiment of the nozzle 102 can be or include a cylindrically-shaped tube 110 with a substantially uniform outer diameter 112 across substantially an entire height 114 of the nozzle, and having at least one retaining body opening 116 located in an outer wall 118 of the nozzle. Embodiments of the holding body 104 can include a conduit 120, the conduit sized to fit the nozzle there-through, and an alignment opening 122 extending from an outer surface 125 of the holding body to the conduit. Embodiments of the retaining body 106 can be sized to fit within the alignment opening of the holding body and to contact the retaining body opening 116 of the nozzle when the nozzle is inserted in the conduit (e.g., FIG. 1B)

As noted, the cylindrically-shaped tube 110 has a substantially uniform outer diameter 112. For instance, in some such embodiments of the nozzle, other than portions of the nozzle having the retaining body opening, or openings, or threaded portions, the outer diameter of the cylindrically-shaped tube does not have a varying diameter (e.g., a percent variation of ±5, ±1±0.1 or ±0.01% or less in the diameter 112) across the entire height (e.g., at least 90, 95, or 99% of the height 114). That is, the cylindrically-shaped tube of the nozzle is free of shoulders, inserts or other structures that would substantially vary the outer diameter and thereby restrain the translational or rotational movement of the nozzle while being inserted and positioned in the conduit of the holding body.

Non-limiting example embodiments of the cylindrically-shaped tube 110 of the nozzle 102 include right (e.g., FIG. 1C) or oblique (e.g., FIG. 1D) circular cylinders. In some such embodiments, an end of the tube can penetrate into an interior chamber of a fluid delivery tube that the assembly is mounted to (e.g., FIG. 1C, tube end 126, shaped as a right circular cylinder, located inside an interior chamber 128 of packing tube 130). In other embodiments, the end can be flush with a wall of the delivery tube (e.g., FIG. 1D, tube end 126, shaped as an oblique circular cylinder, aligned with a wall 132 of packing tube 130), e.g., to facilitate the unobstructed flow of the fluid through the fluid delivery tube and reduce erosion of the end of the tube 110 of the nozzle 102.

Embodiments of the nozzle can be composed of carbide, ceramic materials, cobalt metal alloys, a surface-hardened metals, or alloys or composites thereof, or other erosion resistant metal materials familiar to those skilled in the pertinent art. Embodiments of the holding body can be composed of metal or metal alloys (e.g., stainless steel).

The holding body 104 and retaining body 106, when connected to the nozzle 102, cooperate to prevent the nozzle's cylindrically-shaped tube 110 from either axial or rotational movement, e.g., to prevent the tube from getting pushed in or out of the conduit 120 due to slurry fluid pressure and to prevent the tube from rotating in the conduit. To facilitate axial and rotational adjustment and positioning of the tube 110 in the conduit, embodiments of the conduit 120 can be a cylindrically-shaped opening with a uniform inner diameter (e.g., FIG. 1A, diameter 140) that is greater than the uniform outer diameter 112 of the cylindrically-shaped tube 110 of the nozzle 102.

In any such embodiments, the conduit 120 passing through the holding body 104 can have an acute angle relative to a mounting surface of the holding body (e.g., FIG. 1A, 1C, angle 142 relative to mounting surface 144) although in other embodiments, a perpendicular angle can be formed. Such an acute angled conduit 120 can facilitate efficient fluid flow through the conduit in a same general direction as the fluid flow through the fluid delivery tube (e.g., FIG. 1C slurry fluid flow direction 146).

In some embodiments, the holding alignment opening 122 can form a substantially right angle relative to the holding body conduit angle 142 (e.g., FIG. 1A, 1C, holding alignment opening angle 147, 90°±5°), e.g., to facilitate alignment of the retaining body opening 116 with the holding alignment opening 122 as the tube's 110 position is adjusted. However, in other embodiments, the angle 147 can be an acute or obtuse angle.

Embodiments of the retaining body opening 116 of the nozzle can be a through-hole opening that breaks through to the interior space of the nozzle (e.g., FIGS. 1C-1D, opening 116 breaks into interior space 129), or, a blind-hole (shoulder-hole) opening for the retaining body to rest against, such that the opening 116 does not break through to the interior space (e.g., for embodiments shown in FIGS. 1E-1F the opening 116 does not breaks into interior space 129). For instance, in some embodiments, the retaining body opening 116 can be a blind-hole opening shaped as a slot in the outer wall of the nozzle 102 (e.g., FIG. 1A showing a scalloped-shaped opening 116, in the outer wall 118 of a carbide nozzle 102).

When the nozzle tube 110 is inserted into the holding block conduit 120, the tube 110 can be axially and rotationally adjusted so that the opening 116 matches up with the alignment opening 122 of the holding body. After such adjustments the retaining body 106 can be placed in the alignment opening 122 and contacted to the retaining body opening 116 such that the nozzle cannot be further rotated or axially moved in or out of the conduit.

Embodiments of the retaining body 106 can be shaped and sized to fit in whole or in part in the alignment opening 122. For instance, the retaining body 106 can be a screw (e.g., set screw 106, FIG. 1A, 1C, 1D) or a pin (e.g., retaining pin 106, FIG. 1E). In some such embodiments, the alignment opening 122 can be tapered (e.g., FIG. 1E, tapered from narrow closest to the conduit and wider towards the holding body surface 125) and the retaining body 106 can be a tapered pin (a press fit pin, or other fastening pins locking pins as familiar to one skilled in the pertinent art) or tapered screw configured to fit into the tapered opening and contact the retaining body opening 116 of the nozzle. In some such embodiments, the alignment opening 122 can be a threaded opening and/or the retaining body can be thread shaped to engage with the threaded opening and contact the slot in the tube of the nozzle (e.g., FIGS. 1C-1D, alignment opening 122 with threads 123, and dog point or other set screw or other retaining body opening with threads 124).

In some embodiments, the retaining body opening 116 can be a blind-hole opening shaped as a groove that traverses partly around a circumference of the outer wall 118 of the nozzle (e.g., FIGS. 1F-1H, grooved opening 116 partly traversing circumference 150). That is, retaining body opening 116 shaped as a groove that traverses less than 360 degrees around the outer wall 118, e.g., so as to prevent rotation of the cylindrically-shaped tube 110 once the retaining body 106 is contacted to the retaining body opening 116. For instance, in various embodiments, the grooved opening 116 can traverse from 1 to 90, 90 to 180, 180 to 270, or 270 to 359 degrees around circumference of the outer wall. In some such embodiments, the alignment opening 122 of the holding body 104, can be a partly-circular opening and the retaining body opening 122 can be sized to align with the partly-circular alignment opening such that when the retaining body 106 is located in the opening 122 it will contact the grooved opening 116 of the nozzle 102 such that the nozzle cannot rotate or move further in or out of the conduit 120. In some such embodiments, the retaining body 106 can be shaped as a partly-circular body such as a snap ring (FIG. 1G) or snap wire (FIG. 1H). For instance, as illustrated in FIGS. 1G-1H, for some embodiments where the grooved opening 116 is formed to traverse about 250 to 270 degrees around the circumference 150 of the nozzle 102, then the partly-circular alignment opening 122 of the holding body 104 can be an about same-sized partly-circular opening (e.g., within ±5, ±10, or ±15 degrees of the grooved opening 116, in some embodiments) and the partly-circular retaining body 106 can be shaped to have a smaller (e.g., 5, 10 or 15 degrees smaller in some embodiments) circumference such that partly-circular retaining body 106 can fit through the partly-circular alignment opening 122 and align with and contact the grooved opening 116.

For any embodiments of the retaining body 106 such as discussed in the context of FIGS. 1A-1H the retaining body 106 can be further secured in the retaining body opening 116 via a weld (e.g., FIG. 1E, tag-weld 152).

For any embodiments of the tube 110 and conduit 120 such as discussed in the context of FIGS. 1A-1H, to facilitate securing the nozzle 102 in the holding body 104, all or a portion the conduit 120 can be threaded and at least portion of the tube can be threaded (e.g., FIG. 1E, conduit threads 160, tube thread 162 shaped to thread into each other).

As illustrated in FIGS. 1A-2, the wellbore downhole tool 100 can further include a packing tube 130, the packing tube having an opening (e.g., exit hole 165), such that when the holding body 104 is mounted to the packing tube so that the nozzle 102 is aligned with the opening in the packing tube to allow fluid flow there-through.

As further illustrated, in some embodiments, the packing tube 130 includes one or more planar outer surfaces (e.g., surface 134) which can define a rectangle cross-section of the packing tube. In some such embodiments, the mounting surface 144 of the holding body 104 can also include one or more planar surfaces to facilitate mounting on one or more of the planar outer surfaces 167 of the packing tube. However, in other embodiments, the packing tube 130 can be cylindrically shaped and the mounting surface 144 of the holding body 104 can be a curved surface to facilitate mounting to such a cylindrically shaped packing tube 130.

For any of the embodiments of the holding body and the packing tube, such as discussed in the context of FIGS. 1A-2, a weld can be formed between a mounting surface 144 of the holding body 104 and a surface 134 of the packing tube 130 (e.g., FIG. 1B, weld 170). Additionally or alternatively, for any of the embodiments of the holding body and the packing tube, a mechanical connection can be formed between a mounting surface 144 of the holding body 104 and a surface of the packing tube 130 (e.g., FIG. 1B, one or more screw or pin 172 fastened into one or more predrilled holes 175 in a packing tube surface 134).

As illustrated in FIG. 2, the wellbore downhole tool 100 can further include a shunt tube system 204 of which the packing tube 130 is part of. Embodiments of the shunt tube system 204 can further include a transport tube 212 is connected to the packing tube 213 by conduits 214. The packing tube 213 can include one or more of the nozzle assemblies 101 mounted thereto. The arrows 203 show the path in which a slurry fluid (e.g., a gravel slurry 208) can flow within the shunt tube system 204. For instance, a gravel slurry can be transported primarily in the transport tube 212 and upon reaching a conduit 214, the gravel slurry flows through the conduit 214 to the packing tube 213. The gravel slurry exits the packing tube 213 via the nozzles 102 (FIG. 1A-1H) of the nozzle assemblies 101 into an annulus between a screen 202 of the tool 100 and the wall of the well bore (not shown). As the gravel slurry exits the nozzles, the gravel accumulates in the annulus to the point of providing a gravel pack about the screen 202. As the gravel pack is sufficiently packed around one nozzle, the pressure rises and the gravel slurry then flows to the next nozzle or set of nozzles, via the path of least resistance.

FIG. 3 presents further aspects of embodiments of the wellbore downhole tool 100 which includes one or more of the shunt tube systems 204 and any embodiments of the nozzle assembly 101 as disclosed herein. Each shunt tube system 204 of the tool 100 can include the transport tube 212 and the packing tube 213. The packing tube 213 includes at least one of the nozzle assemblies (e.g., one or more of the nozzle assembly 101 depicted in FIGS. 1A-2) that can output or deposit gravel slurry from the shunt tube system 204 upon or about the screen 202. The transport tube 212 and the packing tube 213 can be positioned exterior to the screen 202. The packing tube 213 is fluidly connected to the transport tube 212 by the conduits 214. Gravel slurry can flow through the transport tube 212 until the gravel slurry reaches a conduit 214 where the gravel slurry can then flows to the packing tube 213. The gravel slurry can flow through the packing tube 213 to the point in which the slurry can exit via a nozzle. The slurry exits the nozzle on the exterior of the screen joint, and the slurry fills the gap between the exterior of the screen and the interior of the wellbore, as familiar to one skilled in the pertinent art. In the embodiment shown in FIG. 3, two sets of transport tubes 212 and packing tubes 213 are shown. In other embodiments, a single set of transport tubes 212 and packing tubes 213 can be part of the tool 100. In other embodiments, more than two sets of transport tubes and packing tubes can be part of the tool 100.

FIG. 4 presents further aspects of embodiments of the wellbore downhole tool 100 employed in a well system 400. Embodiments of the well system 400 can include one or more of the wellbore downhole tools 100 which includes any one or more of nozzle assembly embodiments as disclosed herein. The well system 400 includes a bore (e.g., wellbore 402) extending through various earth strata 410. The wellbore 402 can have a substantially vertical section 404 and a substantially horizontal section 406. The substantially horizontal section 406 can include a heel region 416 and a toe region 418, the heel region 416 upstream from the toe region 418. The substantially vertical section 404 can include a casing string 408 cemented at an upper portion of the substantially vertical section 404. In some embodiments, a substantially vertical section may not have a casing string. The substantially horizontal section 406 is open hole and extends through a hydrocarbon bearing subterranean formation of the strata 410. In some embodiments, the substantially horizontal section may have a casing. A completion string 412 extends from the surface within the wellbore 402. The completion string 412 can provide a conduit for formation fluids to travel from the substantially horizontal section 406 to the surface or for injection fluids to travel from the surface to the wellbore for injection wells. The substantially horizontal section 406 can include a plurality of the tools 100. For instance the tool 100 can be interconnected to the completion string 412. A gravel pack 420 can be installed about the shunt tube system (e.g., FIGS. 2-3, shunt tube system 204) of the tool 100 as well as throughout a portion of the wellbore 402. While FIG. 4 shows exemplary portions of a well bore 402 including embodiments of downhole tool 100 as disclosed here, any number of tools 100 with the shunt tube system can be employed in the well system 400. Further, the distance between or relative position of each tool can be modified or adjusted to provide the desired production set up.

FIG. 4 further illustrates an embodiment of the well system 400 including a workover rig or truck 430 that supplies basepipe 435 to which the downhole tool 100, including the nozzle assembly 101, can be attached. The system 400 may include a computer for controlling and monitoring the operations of the tool 100 during the packing operations. E.g., the operator may use a conventional monitoring system to determine when the tool 100 has reached the appropriate depth in the casing 408 of the wellbore 402. When the appropriate depth is reached, as part of the packing operations, polymer seals may be caused to swell or expand, and packing operations can be conducted on one or more plugging zones in the wellbore 402 as familiar to one skilled in the pertinent art.

Another embodiment of the present disclosure is a method of assembling a wellbore downhole tool including any embodiments of the tool 100 disclosed in the context of FIGS. 1A-4. With continuing reference to FIGS. 1A-5 throughout, embodiments of the method 500 include assembling a nozzle assembly 101 (FIG. 5, step 505). Assembling the nozzle assembly (step 505) can include providing a holding body 104 (step 510), the holding body including a conduit 120 and an alignment opening 122 extending from an outer surface 125 of the holding body to the conduit 120. Assembling the nozzle assembly (step 505) can include inserting a nozzle 102 into the conduit 120 (step 515), the nozzle including a cylindrically-shaped tube 110 with a uniform outer diameter 112 across an entire height 114 of the nozzle and having at least one retaining body opening 116 located in an outer wall 118 of the nozzle. Assembling the nozzle assembly (step 505) can include inserting a retaining body 106 into the alignment opening 122 of the holding body 104 to contact the retaining body opening 116 of the nozzle 102 such that the cylindrically-shaped tube 110 of the nozzle 102 cannot rotate or move further in or out of the conduit 120 (step 520).

In some such embodiments, inserting the nozzle into the conduit (step 515) further includes rotating the cylindrically-shaped tube in the conduit to align the at least one retaining body opening with the alignment opening (step 525).

In some such embodiments, inserting the nozzle into the conduit (step 515) further includes threading the nozzle into the conduit such that threads on the outer wall of nozzle 162 engage with threads on an interior wall of the conduit (e.g. conduit threads 160).

In some such embodiments, inserting the retaining body into the alignment opening (step 520) includes threading the retaining body into the alignment opening such that threads on an outer wall of the retaining body (e.g., threads 124) engage with threads on an interior wall of the alignment opening (e.g., threads 123).

In some such embodiments, inserting the retaining body into the alignment opening (step 520) includes placing the retaining body having a partly-circular shape (e.g., FIG. 1G-1H, a snap ring or snap wire retaining body 106) into the alignment opening shaped as a partly-circular opening (e.g., FIGS. 1F-1H, partly-circular opening 116).

Any such embodiments of the method 500 can further include mounting the nozzle assembly to a packer tube of a shunt tube system (step 530). Embodiments of the mounting (step 530) can include welding the holding body to the packer tube (e.g., FIG. 1B, weld 170) and/or mechanically connecting the holding body to the packer tube (e.g., FIG. 1B, one or more screw or pins 172 fastened into one or more predrilled holes 175).

Disclosure Statements.

Statement 1. a wellbore downhole tool, comprising a nozzle assembly, the nozzle assembly including: a nozzle, the nozzle including a cylindrically-shaped tube with a substantially uniform outer diameter across substantially an entire height of the nozzle, and having at least one retaining body opening located in an outer wall of the nozzle; a holding body, the holding body including: a conduit, the conduit sized to fit the nozzle there-through, an alignment opening extending from an outer surface of the holding body to the conduit; and a retaining body, the retaining body sized to fit within the alignment opening of the holding body and to contact the retaining body opening of the nozzle when the nozzle is inserted in the conduit such that the cylindrically-shaped tube of the nozzle cannot rotate or move further in or out of the conduit.

Statement 2. The tool of statement 1, wherein the conduit of the holding body is a cylindrically-shaped opening with a uniform inner diameter that is greater than the uniform outer diameter of the cylindrically-shaped tube of the nozzle.

Statement 3. The tool of statement 1, wherein the retaining body opening of the nozzle is a through-hole opening that breaks through to the interior space of the nozzle.

Statement 4. The tool of statement 1, wherein the retaining body opening of the nozzle is a blind-hole opening that does not break through to the interior space of the nozzle.

Statement 5. The tool of statement 1, wherein the retaining body opening of the nozzle is a blind-hole opening shaped as a slot and the retaining body is sized to fit within the alignment opening and contact the slot such the nozzle cannot rotated in or move further in or out of the conduit.

Statement 6. The tool of statement 1, wherein the alignment opening of the holding body is a tapered opening and the retaining body is a tapered body to fit into the tapered opening and contact the retaining body opening of the nozzle.

Statement 7. The tool of statement 1, wherein the alignment opening of the holding body is a threaded opening and the retaining body is a threaded body to engage with the threaded opening and contact the retaining body opening of the nozzle.

Statement 8. The tool of statement 1, wherein the retaining body opening of the nozzle is a blind-hole opening shaped as a grooved opening that traverses partly around a circumference of the outer wall of the nozzle.

Statement 9. The tool of statement 8, wherein the alignment opening of the holding body is a partly-circular alignment opening sized to align with the grooved opening of the nozzle.

Statement 10. The tool of statement 9, wherein the retaining body is shaped as a partly-circular body and sized to fit in the grooved opening and in the partly-circular alignment opening.

Statement 11. The tool of statement 10, wherein the partly-circular body is a snap ring or a snap wire.

Statement 12. The tool of statement 1, wherein the conduit of the holding body is threaded and at least a portion of the outer wall of the nozzle is threaded to engage with the threaded conduit of the holding body.

Statement 13. The tool of statement 1, further including a packing tube, the packing tube having an opening and the holding body mounted to the packing tube such that the nozzle is aligned with the opening in the packing tube.

Statement 14. The tool of statement 13, wherein the holding body mount to the packing tube include a weld or a mechanical connection.

Statement 15. The tool of statement 13, wherein the packing tube includes one or more planar outer surfaces and the mounting surface of the holding body includes one or more planar surfaces configured to rest on one or more of the planar outer surfaces of the packing tube.

Statement 16. The tool of statement 1, further including a shunt tube system that includes one or more of the nozzle assemblies, a transport tube, a packing tube and interconnecting conduit between the transport and packing tubes, wherein the holding body of each one of the nozzle assemblies is mounted to the packing tube such that the nozzle of each one of the nozzle assemblies is aligned with respective ones of the openings in the packing tube.

Statement 17. A method of assembling a wellbore downhole tool, comprising: assembling a nozzle assembly, including: providing a holding body, the holding body including a conduit and an alignment opening extending from an outer surface of the holding body to the conduit; inserting a nozzle into the conduit, the nozzle including a cylindrically-shaped tube with a uniform outer diameter across an entire height of the nozzle and having at least one retaining body opening located in an outer wall of the nozzle; and inserting a retaining body into the alignment opening of the holding body to contact the retaining body opening of the nozzle, such that the cylindrically-shaped tube of the nozzle cannot be rotated or moved further in or out of the conduit.

Statement 18. The method of statement 17, wherein inserting the nozzle into the conduit includes rotating the cylindrically-shaped tube in the conduit to align the at least one retaining body opening with the alignment opening.

Statement 19. The method of statement 17, wherein inserting the nozzle into the conduit includes threading the cylindrically-shaped tube of the nozzle into the conduit such that threads on the outer wall of cylindrically-shaped tube engage with threads on an interior wall of the conduit.

Statement 20. The method of statement 17, wherein inserting the retaining body into the alignment opening includes threading the retaining body into the alignment opening such that threads on an outer wall of the retaining body engage with threads on an interior wall of the alignment opening.

Those skilled in the art to which this application relates will appreciate that other and further additions, deletions, substitutions and modifications may be made to the described embodiments.

What is claimed is:

1. A wellbore downhole tool, comprising:

a nozzle assembly, the nozzle assembly including:

a nozzle, the nozzle including a cylindrically-shaped tube with a substantially uniform outer diameter across substantially an entire height of the nozzle, and having at least one retaining body opening located in an outer wall of the nozzle;

a holding body, the holding body including:

a conduit, the conduit sized to fit the nozzle therethrough, an alignment opening extending from an outer surface of the holding body to the conduit; and a retaining body, the retaining body sized to fit within the alignment opening of the holding body and to contact the retaining body opening of the nozzle when the nozzle is inserted in the conduit such that the cylindrically-shaped tube of the nozzle cannot rotate or move further in or out of the conduit.

2. The tool of claim 1, wherein the conduit of the holding body is a cylindrically-shaped opening with a uniform inner diameter that is greater than the uniform outer diameter of the cylindrically-shaped tube of the nozzle.

3. The tool of claim 1, wherein the retaining body opening of the nozzle is a through-hole opening that breaks through to the interior space of the nozzle.

4. The tool of claim 1, wherein the retaining body opening of the nozzle is a blind-hole opening that does not break through to the interior space of the nozzle.

5. The tool of claim 1, wherein the retaining body opening of the nozzle is a blind-hole opening shaped as a slot and the retaining body is sized to fit within the alignment opening and contact the slot such the nozzle cannot rotated in or move further in or out of the conduit.

6. The tool of claim 1, wherein the alignment opening of the holding body is a tapered opening and the retaining body is a tapered body to fit into the tapered opening and contact the retaining body opening of the nozzle.

7. The tool of claim 1, wherein the alignment opening of the holding body is a threaded opening and the retaining body is a threaded body to engage with the threaded opening and contact the retaining body opening of the nozzle.

8. The tool of claim 1, wherein the retaining body opening of the nozzle is a blind-hole opening shaped as a grooved opening that traverses partly around a circumference of the outer wall of the nozzle.

9. The tool of claim 8, wherein the alignment opening of the holding body is a partly-circular alignment opening sized to align with the grooved opening of the nozzle.

10. The tool of claim 9, wherein the retaining body is shaped as a partly-circular body and sized to fit in the grooved opening and in the partly-circular alignment opening.

11. The tool of claim 10, wherein the partly-circular body is a snap ring or a snap wire.

12. The tool of claim 1, wherein the conduit of the holding body is threaded and at least a portion of the outer wall of the nozzle is threaded to engage with the threaded conduit of the holding body.

13. The tool of claim 1, further including a packing tube, the packing tube having an opening and the holding body mounted to the packing tube such that the nozzle is aligned with the opening in the packing tube.

14. The tool of claim 13, wherein the holding body mount to the packing tube include a weld or a mechanical connection.

15. The tool of claim 13, wherein the packing tube includes one or more planar outer surfaces and the mounting surface of the holding body includes one or more planar surfaces configured to rest on one or more of the planar outer surfaces of the packing tube.

16. The tool of claim 1, further including a shunt tube system that includes one or more of the nozzle assemblies, a transport tube, a packing tube and interconnecting conduit between the transport and packing tubes, wherein the holding body of each one of the nozzle assemblies is mounted to the packing tube such that the nozzle of each one of the nozzle assemblies is aligned with respective ones of the openings in the packing tube.

17. A method of assembling a wellbore downhole tool, comprising:

assembling a nozzle assembly, including:

providing a holding body, the holding body including a conduit and an alignment opening extending from an outer surface of the holding body to the conduit;

inserting a nozzle into the conduit, the nozzle including a cylindrically-shaped tube with a uniform outer diameter across an entire height of the nozzle and having at least one retaining body opening located in an outer wall of the nozzle; and inserting a retaining body into the alignment opening of the holding body to contact the retaining body opening of the nozzle, such that the cylindrically-shaped tube of the nozzle cannot be rotated or moved further in or out of the conduit.

18. The method of claim 17, wherein inserting the nozzle into the conduit includes rotating the cylindrically-shaped tube in the conduit to align the at least one retaining body opening with the alignment opening.

19. The method of claim 17, wherein inserting the nozzle into the conduit includes threading the cylindrically-shaped tube of the nozzle into the conduit such that threads on the outer wall of cylindrically-shaped tube engage with threads on an interior wall of the conduit.

20. The method of claim 17, wherein inserting the retaining body into the alignment opening includes threading the retaining body into the alignment opening such that threads on an outer wall of the retaining body engage with threads on an interior wall of the alignment opening.

* * * * *